US008708780B2

(12) United States Patent
Yamamoto

(10) Patent No.: US 8,708,780 B2
(45) Date of Patent: Apr. 29, 2014

(54) HONING APPARATUS

(75) Inventor: Yasutaka Yamamoto, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 237 days.

(21) Appl. No.: 13/404,270

(22) Filed: Feb. 24, 2012

(65) Prior Publication Data

US 2012/0231709 A1 Sep. 13, 2012

(30) Foreign Application Priority Data

Mar. 7, 2011 (JP) ..... 2011-049016

(51) Int. Cl.
*B24B 1/00* (2006.01)

(52) U.S. Cl.
USPC ..... 451/119; 451/51; 451/56; 451/72; 451/61; 451/443

(58) Field of Classification Search
USPC ..... 451/51, 56, 72, 61, 443, 27, 464–485
See application file for complete search history.

(56) References Cited

U.S. PATENT DOCUMENTS 3,195,280 A * 7/1965 Crowe ..... 451/540
3,225,496 A * 12/1965 Sunnen ..... 451/487
3,861,091 A * 1/1975 McDonald ..... 451/476
4,367,389 A * 1/1983 Inoue ..... 219/69.17
5,177,904 A * 1/1993 Nagel et al. ..... 451/27
5,269,103 A * 12/1993 Nagel et al. ..... 451/8
6,244,939 B1 * 6/2001 Ohmori et al. ..... 451/72
6,537,138 B2 * 3/2003 Ohmori et al. ..... 451/56
6,547,648 B1 * 4/2003 Zhu et al. ..... 451/49
8,303,799 B2 * 11/2012 Yamamoto et al. ..... 205/662
8,500,988 B2 * 8/2013 Lin et al. ..... 205/640
2008/0057835 A1 3/2008 Yamamoto et al.
2010/0240284 A1 9/2010 Lin et al.

FOREIGN PATENT DOCUMENTS

JP 2007-260816 10/2007

* cited by examiner

*Primary Examiner* — George Nguyen

(74) *Attorney, Agent, or Firm* — Smith, Gambrell & Russell, LLP.

(57) ABSTRACT

A rotary tool of a honing apparatus is provided with honing grindstones that grind a cylinder bore, and guide members that slide in a guide hole of a tool guide. The guide members are each constituted of a base member fixed to the tool body and a slide member fixed to the base member. The base member is composed of a ceramic material, and the slide member is composed of a cemented carbide material. With the guide members having such a configuration, electrolytic dressing is performed on the honing grindstones.

16 Claims, 10 Drawing Sheets

HONING APPARATUS

CROSS REFERENCES TO RELATED APPLICATIONS

The present application claims priority from Japanese Patent Application No. 2011-049016 filed on Mar. 7, 2011, the entire contents of which are hereby incorporated by reference.

BACKGROUND OF THE INVENTION

1. Field of the Invention

The present invention relates to a honing apparatus including a rotary tool that grinds an inner cylindrical surface to be formed in a workpiece and a tool guide that guides the rotary tool to the inner cylindrical surface.

2. Description of the Related Art

Cylinder blocks of engines have cylinder bores that accommodate pistons in a slidable manner. The inner surface of a cylinder bore is honed by using a rotary tool equipped with a honing grindstone. If clogging or shedding occurs on the honing grindstone, the cylinder bore cannot be properly ground, resulting in reduced processing accuracy for the cylinder bore. In order to maintain the processing accuracy for the cylinder bore, it is necessary to regularly dress the honing grindstone by using a tool or the like. However, performing regularly such a dressing process leads to an increase in the operating costs.

In light of this, a honing apparatus that uses metal-bonded grindstones as honing grindstones and in which an electrode is fitted to a honing guide for guiding the rotary tool has been proposed (for example, see Japanese Unexamined Patent Application Publication No. 2007-260816). With this honing apparatus, the metal-bonded grindstones can be dressed by performing electrolysis when the rotary tool passes through the honing guide, thereby allowing for a simplified dressing process.

The rotary tool has a guide member attached thereto, such that when the rotary tool is inserted into a guide hole in the honing guide, the guide member slides on an inner peripheral surface of the guide hole. However, in order to perform electrolytic dressing on the metal-bonded grindstones, the guide member sliding in the guide hole needs to be insulated. Thus, the guide member is composed of an insulating material, such as a ceramic material.

However, using a ceramic material having low durability for forming the guide member that slides in the honing guide may sometimes lead to abrasion of the guide member. Since such abrasion of the guide member shortens the replacement cycle of the guide member, the operating costs of the honing apparatus may increase. In addition, since the abrasion of the guide member leads to contamination of coolant to be supplied during the electrolytic dressing process, the replacement cycle of the coolant is also shortened, causing an increase in the operating costs.

SUMMARY OF THE INVENTION

An object of the present invention is to reduce the operating costs of a honing apparatus equipped with a rotary tool on which electrolytic dressing is performed.

A honing apparatus according to a first aspect of the present invention includes a rotary tool that grinds an inner cylindrical surface to be formed in a workpiece, and a tool guide disposed at one end of the workpiece and having a guide hole that guides the rotary tool to the inner cylindrical surface. The honing apparatus includes a guide member provided on an outer periphery of the rotary tool and having a slide surface that slides in the guide hole; an electrically conductive grindstone provided on the outer periphery of the rotary tool and having a grinding surface that grinds the inner cylindrical surface; an electrode member provided in the guide hole of the tool guide and facing the grinding surface of the electrically conductive grindstone when the rotary tool passes through the guide hole; and an electrolytic dressing unit for applying voltage to the electrically conductive grindstone and the electrode member when the rotary tool passes through the guide hole. The guide member includes a base member provided on the outer periphery of the rotary tool, and a slide member provided on the base member and serving as the slide surface. The base member is composed of a material having higher insulating properties than the slide member, and the slide member is composed of a material having higher abrasion resistance properties than the base member.

Preferably, the base member should be composed of a ceramic material, and the slide member may be composed of a cemented carbide material.

Preferably, the slide surface of the guide member should have an air channel that guides air used for processing-diameter measurement.

A honing apparatus according to a second aspect of the present invention includes a rotary tool that grinds an inner cylindrical surface to be formed in a workpiece, and a tool guide disposed at one end of the workpiece and having a guide hole that guides the rotary tool to the inner cylindrical surface. The honing apparatus includes a guide member provided on an outer periphery of the rotary tool and having a slide surface that slides in the guide hole; an electrically conductive grindstone provided on the outer periphery of the rotary tool and having a grinding surface that grinds the inner cylindrical surface; an electrode member provided in the guide hole of the tool guide and facing the grinding surface of the electrically conductive grindstone when the rotary tool passes through the guide hole; and an electrolytic dressing unit for applying voltage to the electrically conductive grindstone and the electrode member when the rotary tool passes through the guide hole. The guide member includes a base member provided on the outer periphery of the rotary tool and having an insulation layer, and a slide member provided on the base member and serving as the slide surface. The insulation layer is composed of a material having higher insulating properties than the slide member, and the slide member is composed of a material having higher abrasion resistance properties than the insulation layer.

According to the present invention, since the guide member provided in the rotary tool is constituted of the base member having insulating properties and the slide member having abrasion resistance properties, electrolytic dressing can be performed on the electrically conductive grindstone while abrasion of the guide member can be minimized. Accordingly, the replacement cycle of the guide member can be extended, so that the operating costs of the honing apparatus can be reduced. Furthermore, since abrasion of the guide member is minimized, the coolant to be supplied during the electrolytic dressing and honing processes can be prevented from being contaminated. Accordingly, the replacement cycle of the coolant can be extended, whereby the operating costs of the honing apparatus can be reduced.

DESCRIPTION OF THE PREFERRED EMBODIMENTS

Figure 1:
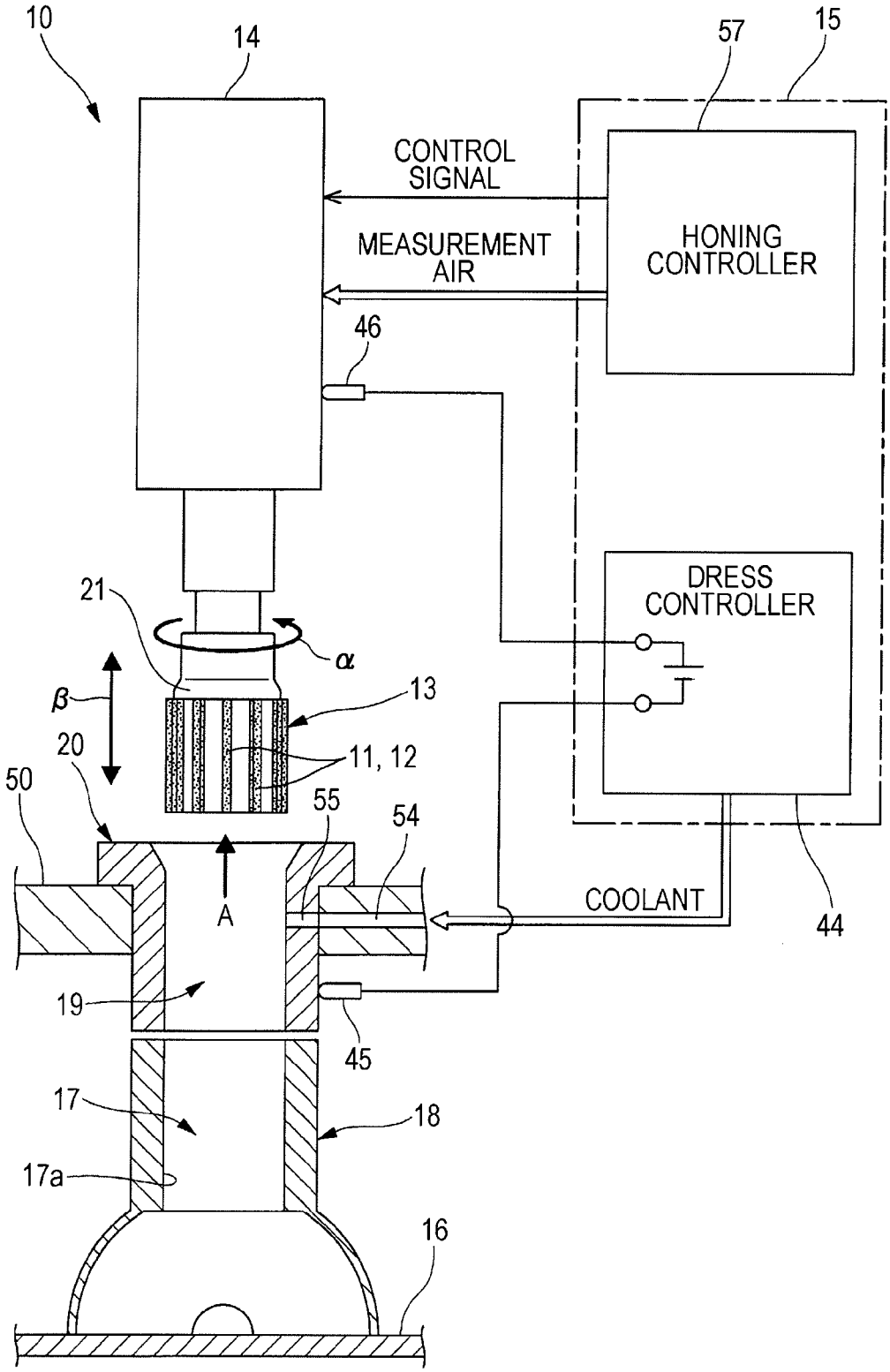
FIG. 1 schematically illustrates a honing apparatus according to an embodiment of the present invention.
Figure 2B:
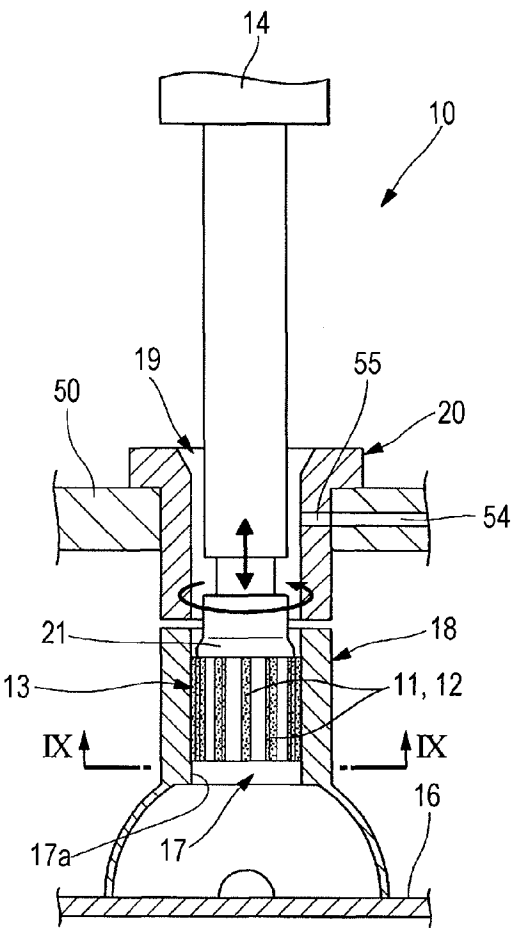
FIGS. 2A and 2B illustrate an operating process of the honing apparatus.
Figure 2A:
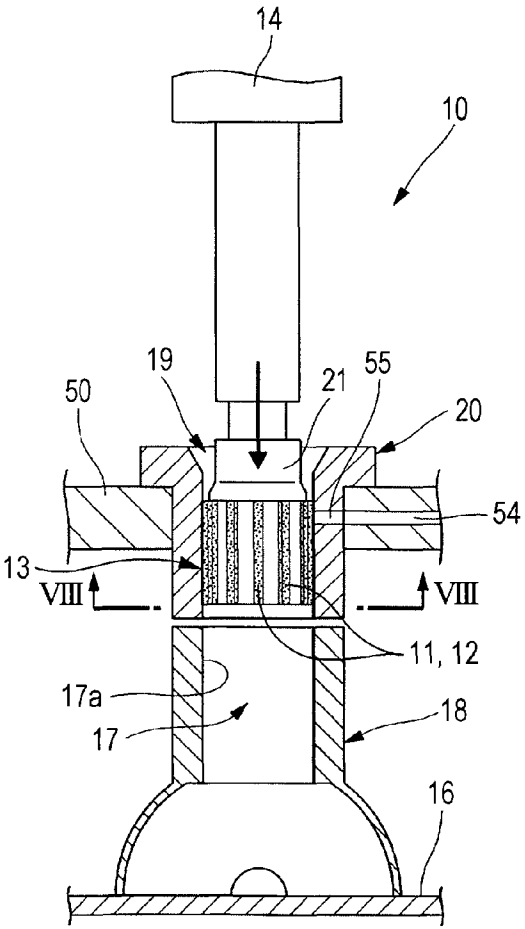

Embodiments of the present invention will be described below with reference to the drawings. FIG. 1 schematically illustrates a honing apparatus 10 according to an embodiment of the present invention. FIGS. 2A and 2B illustrate an operating process of the honing apparatus 10. As shown in FIG. 1, the honing apparatus 10 includes a rotary tool 13 having honing grindstones 11 and 12 on the outer periphery thereof, a driving unit 14 that drives the rotary tool 13, and a control unit 15 that outputs a control signal to the driving unit 14. The driving unit 14 has a built-in electric motor or actuator (not shown). The driving unit 14 can rotate the rotary tool 13 in the direction indicated by an arrow α, as well as vertically move the rotary tool 13 in the direction indicated by an arrow β. The honing apparatus 10 has a processing table 16 on which a cylinder block (workpiece) 18 having a cylinder bore 17 is mounted. Furthermore, the honing apparatus 10 has a tool guide 20 having a guide hole 19. The tool guide 20 is disposed on an upper end (one end) of the cylinder block 18. The tool guide 20 guides the rotary tool 13 to the cylinder bore 17 and is disposed such that the center of the guide hole 19 is positionally aligned with the center of the cylinder bore 17.

Referring to FIG. 2A, when a honing process is to be performed, the rotary tool 13 is first lowered toward the tool guide 20 so that the rotary tool 13 is inserted into the guide hole 19 of the tool guide 20. By inserting the rotary tool 13 into the tool guide 20 in this manner, the center of the cylinder bore 17 can be positionally aligned with the center of the rotary tool 13. Subsequently, referring to FIG. 2B, the rotary tool 13 positioned by the tool guide 20 is inserted into the cylinder bore 17 of the cylinder block 18. Then, while rotating as well as moving in the vertical direction, the rotary tool 13 grinds an inner surface (inner cylindrical surface) 17*a* of the cylinder bore 17 to a predetermined dimension.

Figure 3:
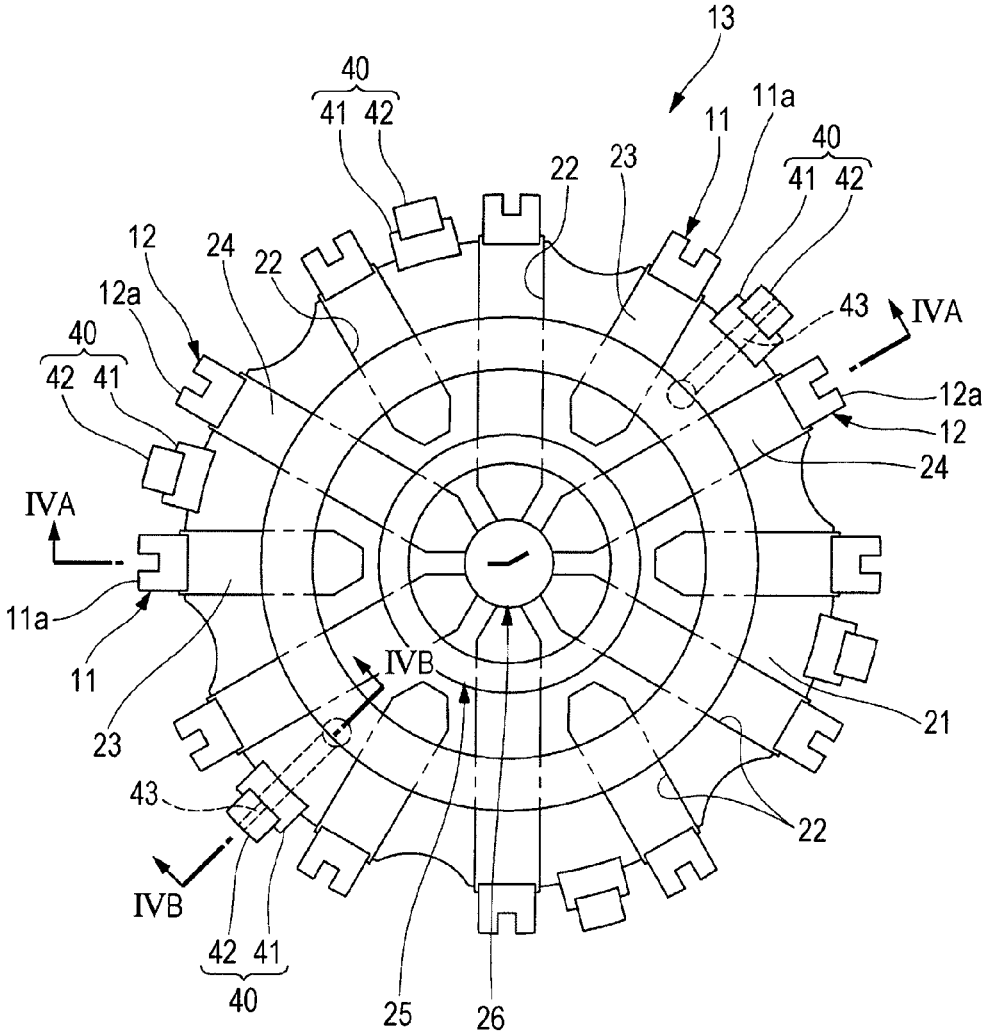
FIG. 3 is a bottom view showing a rotary tool, as viewed in a direction indicated by an arrow A in FIG. 1.
Figure 4A:
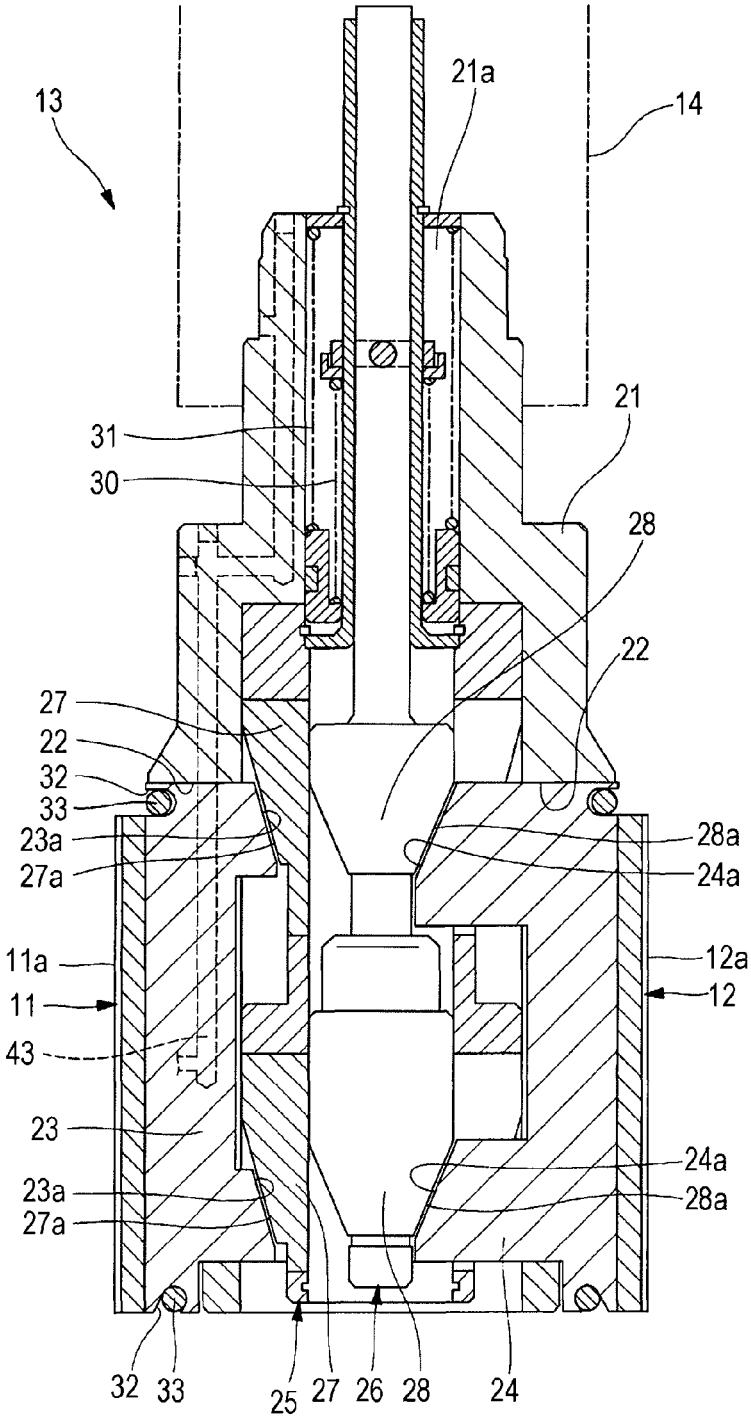
FIG. 4A is a cross-sectional view of the rotary tool taken along line IVA-IVA in FIG. 3.
Figure 4B:
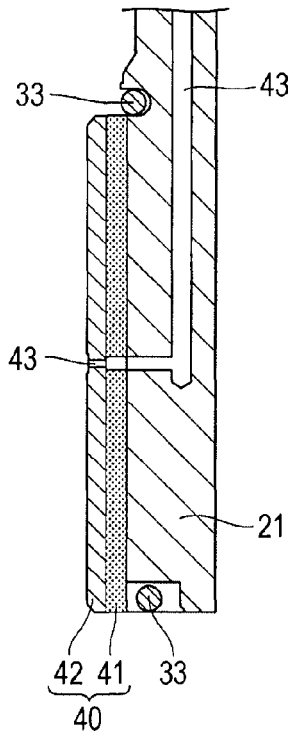
FIG. 4B is a partial cross-sectional view of the rotary tool taken along line IVB-IVB in FIG. 3.

FIG. 3 is a bottom view showing the rotary tool 13, as viewed in the direction of an arrow A in FIG. 1. FIG. 4A is a cross-sectional view of the rotary tool 13 taken along line IVA-IVA in FIG. 3. FIG. 4B is a partial cross-sectional view of the rotary tool 13 taken along line IVB-IVB in FIG. 3. As shown in FIGS. 3 and 4A, the rotary tool 13 has a tool body 21 that is coupled to the driving unit 14, and the tool body 21 is provided with a plurality of slits 22 that extend radially. First extension components 23, in which the honing grindstones (electrically conductive grindstones) 11 having crude-processing grinding surfaces 11*a* are fixed, and second extension components 24, in which the honing grindstones (electrically conductive grindstones) 12 having finish-processing grinding surfaces 12*a* are fixed, are alternately accommodated in the slits 22 in a movable manner in the radial direction of the tool body 21. The honing grindstones 11 and 12 are, for example, so-called metal-bonded grindstones formed by joining together diamond, cubic boron nitride (cBN), aluminum oxide, silicon carbide, or silicon dioxide abrasive grains by using a bonding material mainly composed of bronze or cast iron.

A rod accommodation hole 21*a* extends through the center of the tool body 21 in the axial direction thereof. The rod accommodation hole 21*a* accommodates a first extension rod 25, which has a hollow structure, in a movable manner in the axial direction, and also accommodates a second extension rod 26, which is disposed within the first extension rod 25, in a movable manner in the axial direction. The first extension rod 25 has two cone sections 27, and tapered surfaces 27*a* of these cone sections 27 are disposed facing inclined surfaces 23*a* of the first extension components 23. Likewise, the second extension rod 26 has two cone sections 28, and tapered surfaces 28*a* of these cone sections 28 are disposed facing inclined surfaces 24*a* of the second extension components 24. The first extension rod 25 has a return spring 30 attached thereto such that the first extension rod 25 is biased upward by the spring force of the return spring 30. Similarly, the second extension rod 26 has a return spring 31 attached thereto such that the second extension rod 26 is biased upward by the spring force of the return spring 31. Furthermore, two accommodation grooves 32 are formed along the outer periphery of the first extension components 23 and the second extension components 24, and spring bands 33 that bias the first and second extension components 23 and 24 inward in the radial direction are fitted in these accommodation grooves 32.

In this rotary tool 13, when the driving unit 14 presses the first extension rod 25 downward, a thrust force is transmitted to the first extension components 23 from the first extension rod 25 via the tapered surfaces 27*a* and the inclined surfaces 23*a*, whereby the first extension components 23 are pressed radially outward to an extended position. By releasing the pressing force on the first extension rod 25, the first extension rod 25 ascends due to the return spring 30, whereby the first extension components 23 are pulled radially inward to a contracted position due to the spring bands 33. Similarly, when the driving unit 14 presses the second extension rod 26 downward, a thrust force is transmitted to the second extension components 24 from the second extension rod 26 via the tapered surfaces 28*a* and the inclined surfaces 24*a*, whereby the second extension components 24 are pressed radially outward to an extended position. By releasing the pressing force on the second extension rod 26, the second extension rod 26 ascends due to the return spring 31, whereby the second extension components 24 are pulled radially inward to a contracted position due to the spring bands 33.

As shown in FIGS. 3 and 4B, six guide members 40 are fixed to the outer periphery of the tool body 21, constituting the rotary tool 13, at a predetermined pitch in the circumferential direction. When the first and second extension components 23 and 24 are moved to their extended positions, slide surfaces 40*a* of the guide members 40 are set so as to be positioned radially inward of the grinding surfaces 11*a* and 12*a* of the honing grindstones 11 and 12. On the other hand, when the first and second extension components 23 and 24 are moved to their contracted positions, the slide surfaces 40*a* of the guide members 40 are set so as to be positioned radially outward of the grinding surfaces 11*a* and 12*a* of the honing grindstones 11 and 12. Each guide member 40 is constituted of a base member 41 fixed to the tool body 21 and a slide member 42 fixed to the base member 41. The base member 41 is composed of a material having higher insulating properties than the slide member 42, whereas the slide member 42 is composed of a material having higher abrasion resistance properties than the base member 41. The material used for the base member 41 may be, for example, a ceramic material, such as alumina (aluminum oxide ($Al_2O_3$)) or Sialon (Si—Al—O—N based compound). The material used for the slide member 42 may be, for example, a cemented carbide material. The cemented carbide material used may be, for example, K10 (Japanese Industrial Standard), although another kind of cemented carbide material may be used as an alternative.

Of the six guide members 40, two guide members 40 are provided with air channels 43 that open at the slide surfaces 40*a*. The air channels 43 are connected to an air micrometer (not shown), so that the gap dimension between the slide surfaces 40*a* of the guide members 40 and the inner surface 17*a* of the cylinder bore 17 can be measured. The air micrometer is a measuring unit that detects changes in the pressure, the flow rate, and the flow velocity of processing-diameter measurement air blown into the cylinder bore 17 from a constant pressure device via the air channels 43 so as to measure the gap dimension between the guide members 40 and the cylinder bore 17 based on the changes in the pressure and the flow rate of the air. With the air micrometer connected to the air channels 43, a honing process can be performed on the cylinder bore 17 while checking the inner diameter of the cylinder bore 17 that increases with the grinding process.

Figure 5:
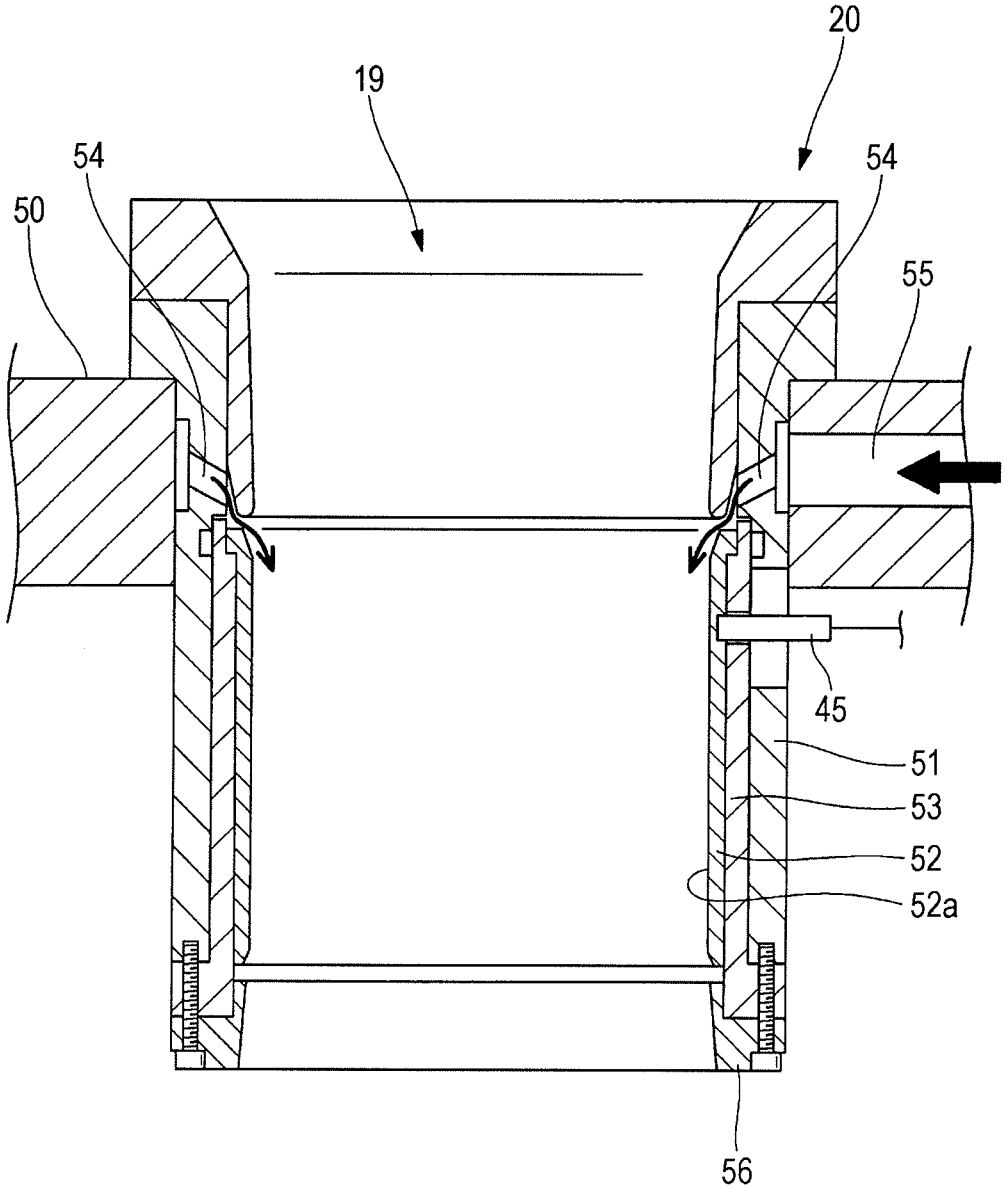
FIG. 5 is a cross-sectional view showing the structure of a tool guide.
Figure 6:
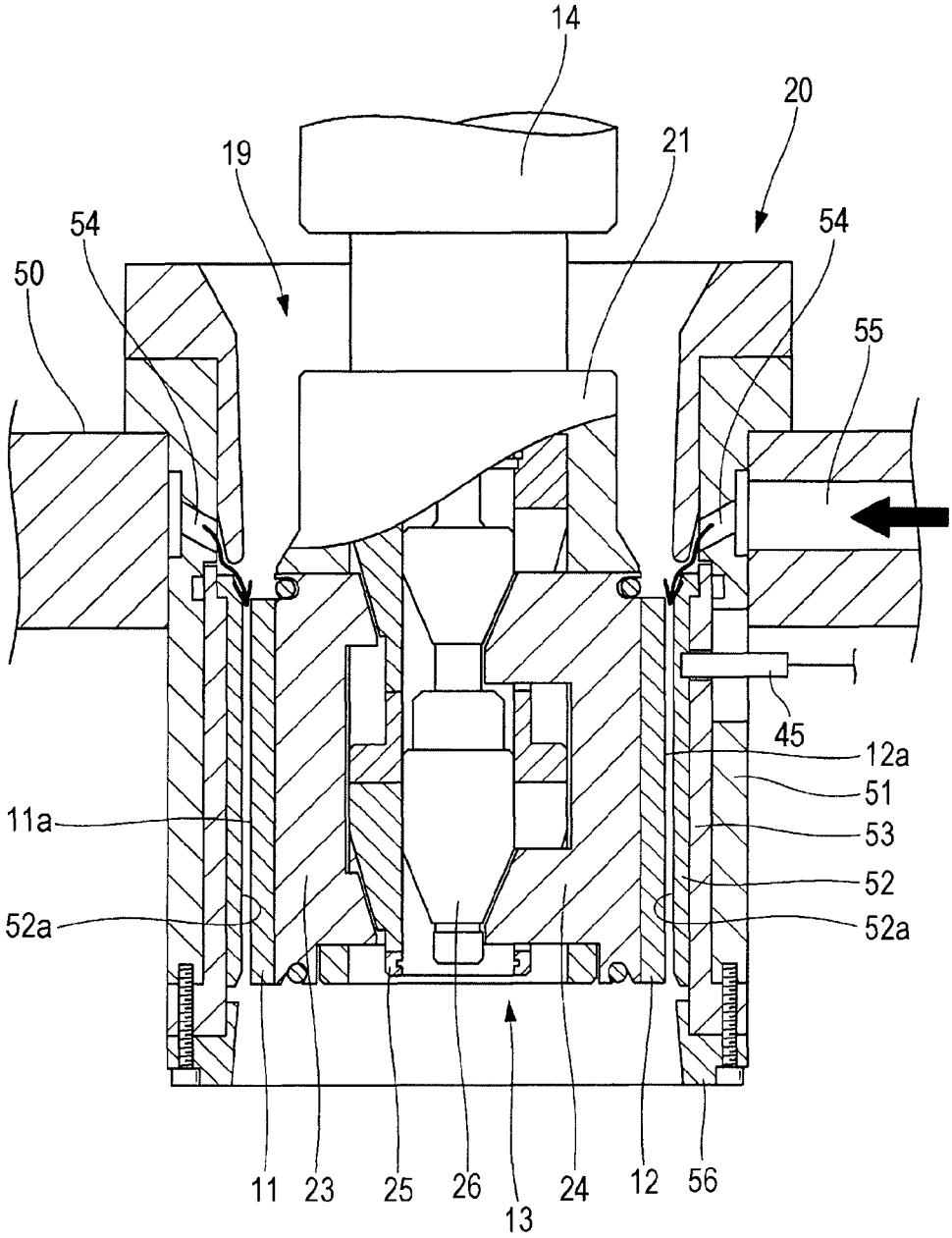
FIG. 6 is a cross-sectional view showing a state where the rotary tool is inserted in the tool guide.

As shown in FIG. 1, a dress controller 44 is included in the control unit 15 for dressing the honing grindstones 11 and 12. A negative terminal 45 extending from the dress controller 44 is connected to the tool guide 20, whereas a positive terminal 46 extending from the dress controller 44 is connected to the rotary tool 13 via the driving unit 14. FIG. 5 is a cross-sectional view showing the structure of the tool guide 20. FIG. 6 is a cross-sectional view showing a state where the rotary tool 13 is inserted in the tool guide 20. As shown in FIGS. 5 and 6, the tool guide 20 has a cylindrical guide body 51 supported by a support member 50, and a cylindrical electrode sleeve (electrode member) 52 is attached within the guide body 51. An insulation sleeve 53 is interposed between the guide body 51 and the electrode sleeve 52, and the electrode sleeve 52 is connected to the negative terminal 45 extending from the dress controller 44. Furthermore, the support member 50 and the guide body 51 are provided with coolant channels 54 and 55. Coolant, which is an electrically-conductive grinding fluid, is supplied into the tool guide 20 from the dress controller 44 via these coolant channels 54 and 55. A corrosion-resistant electrode 56 is attached to a lower end of the guide body 51 that faces the cylinder block 18. The corrosion-resistant electrode 56 is connected to a positive terminal (not shown) extending from the dress controller 44.

Figure 7:
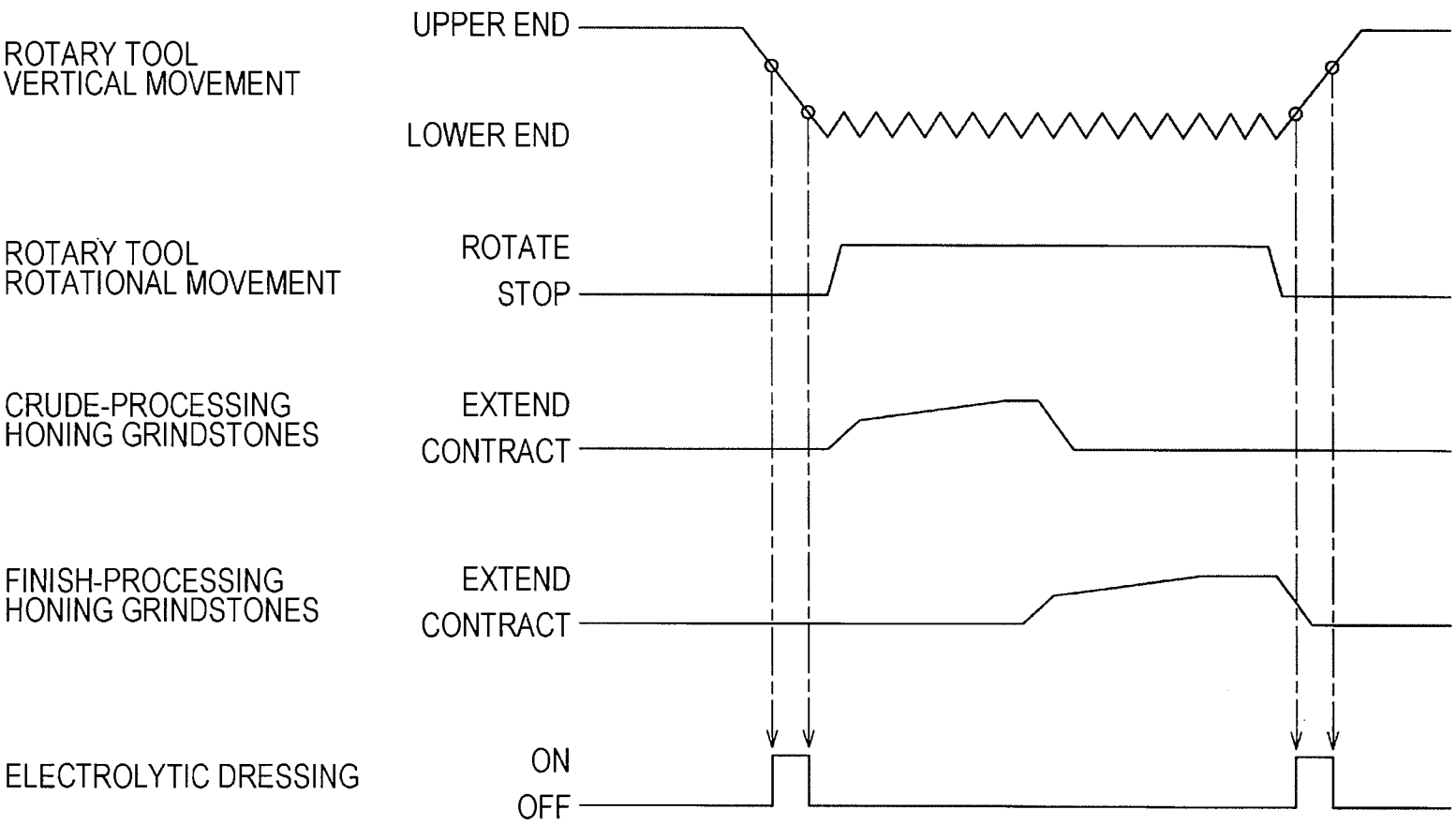
FIG. 7 is a timing chart showing the procedure of a honing process.
Figure 8:
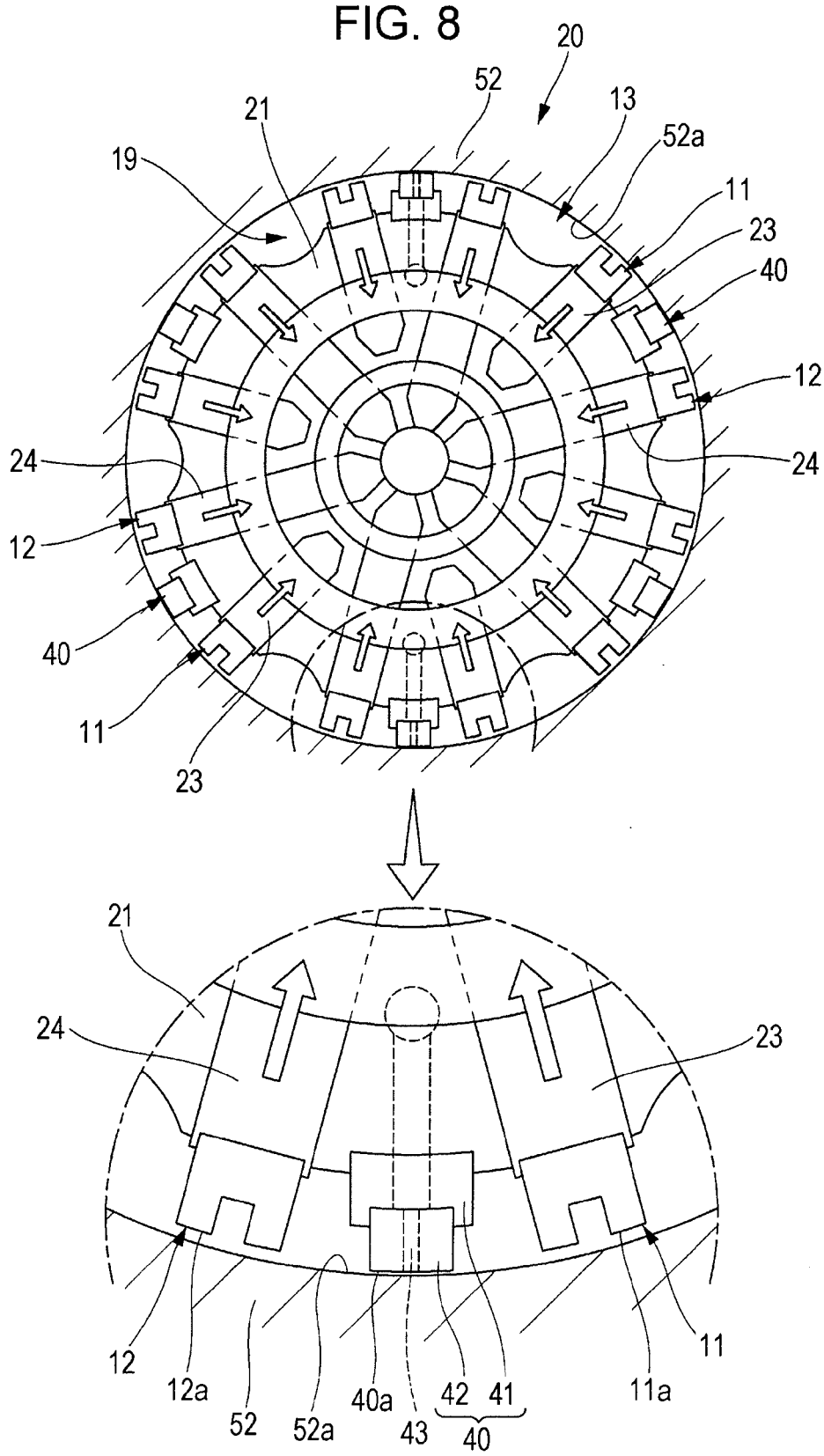
FIG. 8 is a cross-sectional view of the rotary tool and the tool guide, taken along line VIII-VIII in FIG. 2A.
Figure 9:
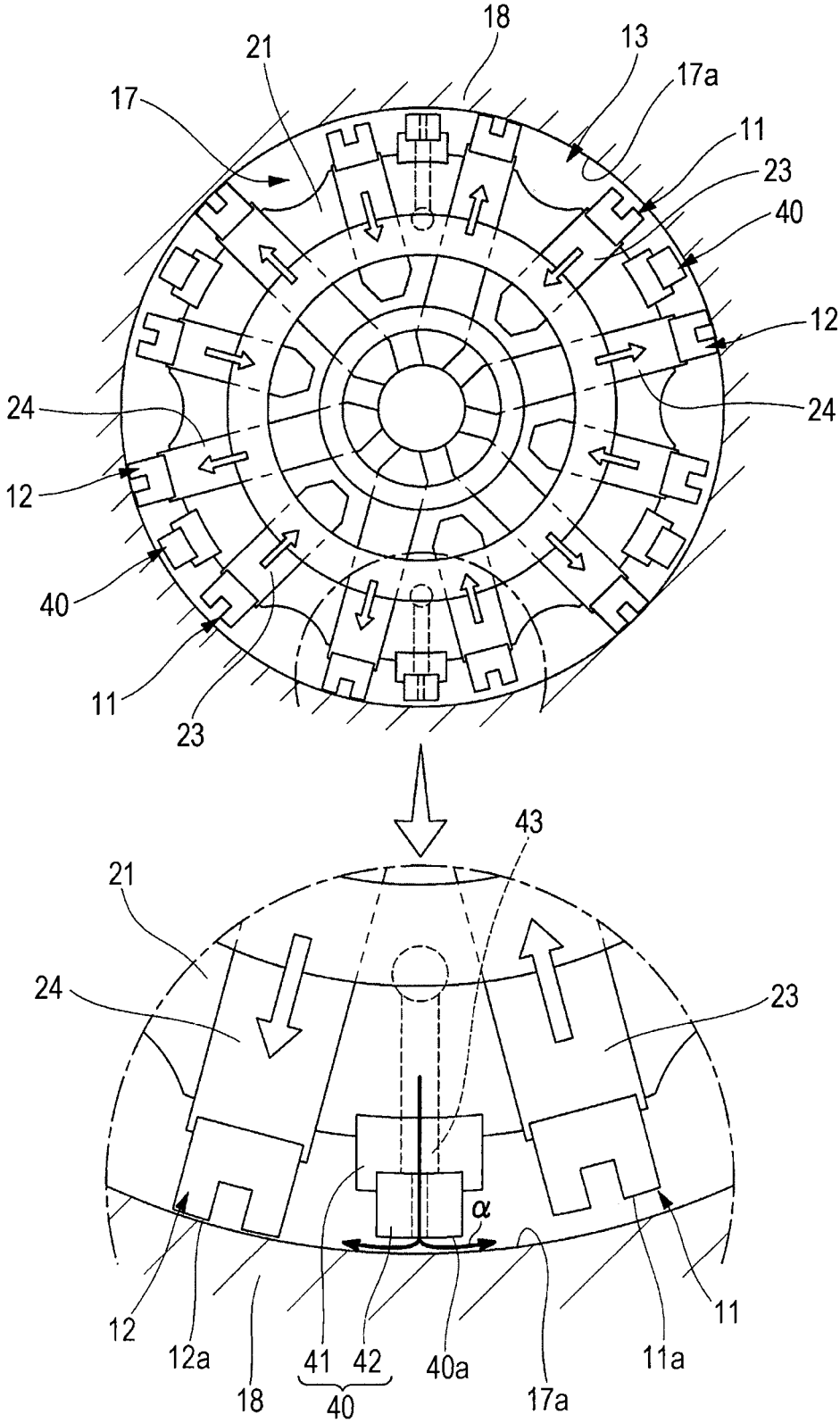
FIG. 9 is a cross-sectional view of the rotary tool and a cylinder block, taken along line IX-IX in FIG. 2A.

Next, the procedure of the honing process will be described. FIG. 7 is a timing chart showing the procedure of the honing process. FIG. 8 is a cross-sectional view of the rotary tool 13 and the tool guide 20, taken along line VIII-VIII in FIG. 2A. FIG. 9 is a cross-sectional view of the rotary tool 13 and the cylinder block 18, taken along line IX-IX in FIG. 2A. As shown in FIG. 7, when the rotary tool 13 is lowered and inserted into the tool guide 20, electrolytic dressing is performed in the course of the lowering process during which the honing grindstones 11 and 12 are brought to face the electrode sleeve 52. In such electrolytic dressing, the dress controller 44 functioning as an electrolytic dressing unit supplies coolant into the tool guide 20 and applies a pulse voltage between the electrode sleeve 52 and the honing grindstones 11 and 12. Thus, the bonding material of the honing grindstones 11 and 12 can be removed by electrolysis, thereby dressing the honing grindstones 11 and 12.

As shown in FIG. 8, when the rotary tool 13 is lowered within the tool guide 20, the honing grindstones 11 and 12 are pulled toward their contracted positions, while the slide surfaces 40*a* of the guide members 40 slide on an electrode surface 52*a* of the electrode sleeve 52. Although the guide members 40 slide on the electrode sleeve 52 when the rotary tool 13 moves through the tool guide 20 in this manner, the slide surfaces 40*a* of the guide members 40 are constituted of the slide members 42 composed of a cemented carbide material. Accordingly, because the slide surfaces 40*a* are composed of a cemented carbide material, abrasion of the guide members 40 can be minimized, whereby the electrolytic dressing can be properly performed.

Specifically, in order to perform the electrolytic dressing properly, it is necessary to reduce a variation in the dressing conditions of the honing grindstones 11 and 12 by managing the gap between the grinding surfaces 11*a* and 12*a* of the honing grindstones 11 and 12 and the electrode surface 52*a* of the electrode sleeve 52. As shown in an enlarged section in FIG. 8, the slide surfaces 40*a* of the guide members 40 are brought into contact with the electrode surface 52*a* of the electrode sleeve 52 so as to maintain a fixed gap between the electrode sleeve 52 and the honing grindstones 11 and 12. Accordingly, since abrasion of the guide members 40 that manage the gap between the electrodes can be minimized, the variation in the dressing conditions of the honing grindstones 11 and 12 can be reduced. With each base member 41 composed of an insulating ceramic material interposed between the tool body 21 and the corresponding slide member 42, an electric current used for the electrolytic dressing is prevented from flowing to the tool body 21 from the slide member 42.

Subsequently, as shown in FIG. 7, when the rotary tool 13 is lowered to the cylinder bore 17, the rotary tool 13 starts rotating as well as moving upward and downward, and the first extension components 23 are pressed toward the extended position. Then, a honing process by the crude-processing honing grindstones 11 continues until the inner diameter of the cylinder bore 17 reaches a predetermined value. Subsequently, when the honing process by the honing grindstones 11 is completed, the first extension components 23 are pulled toward the contracted position, whereas the second extension components 24 are pressed toward the extended position. Subsequently, a honing process by the finish-processing honing grindstones 12 continues until the inner diameter of the cylinder bore 17 reaches a predetermined value. When the rotary tool 13 is lifted upward upon completion of the honing process, the aforementioned electrolytic dressing is performed on the rotary tool 13 again.

In this honing process, abrasion of the guide members 40 is also minimized as the rotary tool 13 moves through the tool guide 20, so that the honing process can be performed with high accuracy. Specifically, as indicated by an arrow $\alpha$ in FIG. 9, during the honing process, air (i.e., air used for processing-diameter measurement) is blown into the gap between the inner surface 17*a* of the cylinder bore 17 and the slide surfaces 40*a* of the guide members 40 from the air channels 43 of the guide members 40 so as to measure the gap dimension between the cylinder bore 17 and the guide members 40. A honing controller 57 in the control unit 15 calculates the inner diameter of the cylinder bore 17 undergoing the honing process on the basis of the gap dimension between the cylinder bore 17 and the guide members 40 and the distance from the central axis of the rotary tool 13 to the slide surfaces 40*a* of the guide members 40. Therefore, if a variation occurs in the distance from the central axis of the rotary tool 13 to the slide surfaces 40*a* of the guide members 40 due to abrasion of the guide members 40, the calculation accuracy for the inner diameter of the cylinder bore 17 would decrease. In contrast, since abrasion of the guide members 40 is minimized, the calculation accuracy for the inner diameter of the cylinder bore 17 can be increased, whereby the honing process can be performed with high accuracy.

As described above, the guide members 40 provided in the rotary tool 13 are each constituted of the base member 41 having insulating properties and the slide member 42 having abrasion resistance properties, thereby allowing for electrolytic dressing of the honing grindstones 11 and 12 as well as minimizing abrasion of the guide members 40. Accordingly, the replacement cycle of the guide members 40 can be extended, so that the operating costs of the honing apparatus 10 can be reduced. Furthermore, since abrasion of the guide members 40 is minimized, the coolant to be supplied during the electrolytic dressing and honing processes can be prevented from being contaminated. Accordingly, the replacement cycle of the coolant can be extended, whereby the operating costs of the honing apparatus 10 can be reduced. Furthermore, since abrasion of the guide members 40 is minimized, a variation in the dressing conditions of the honing grindstones 11 and 12 can be reduced, as mentioned above, whereby the honing process can be performed with high accuracy.

Figure 10:
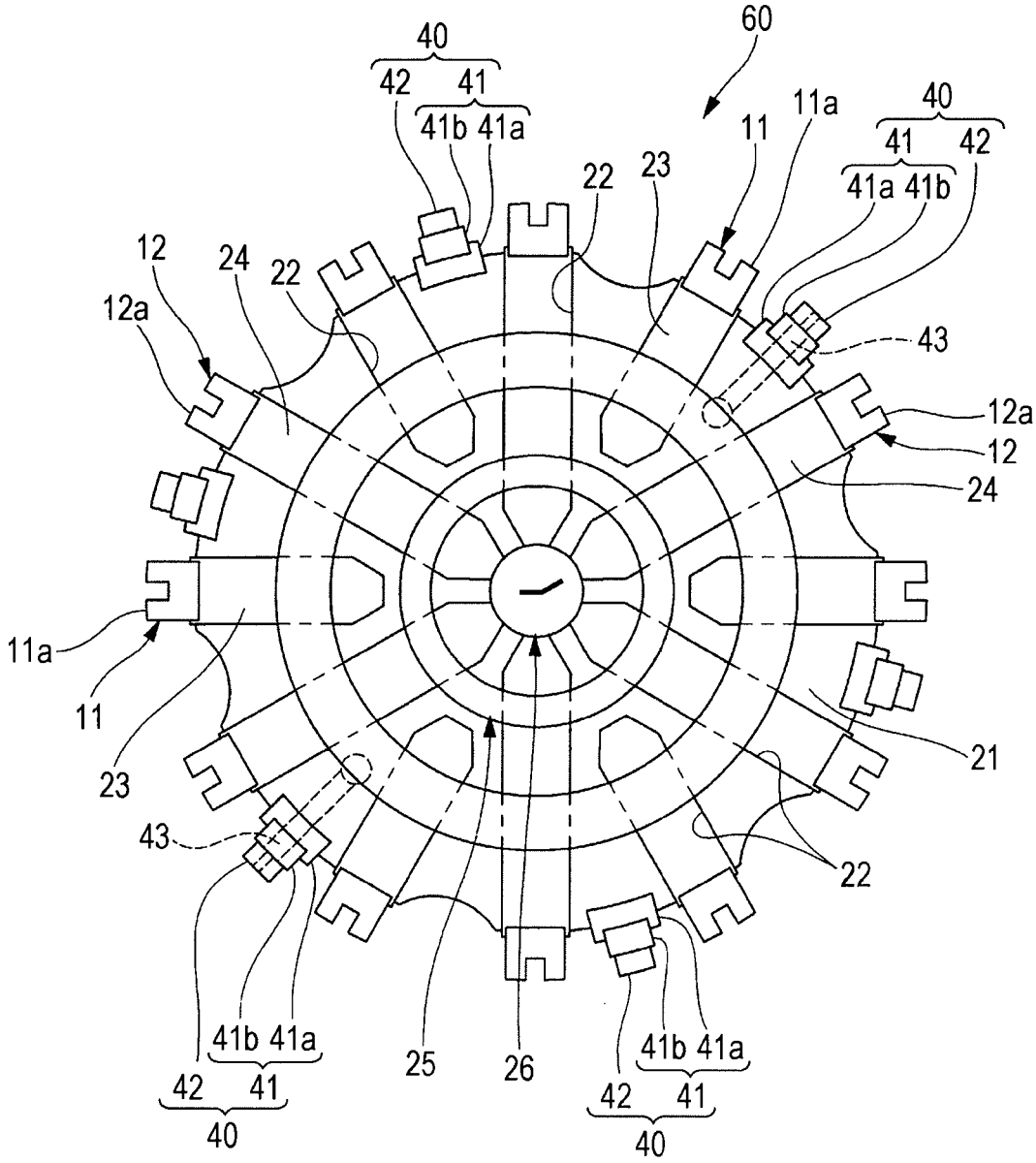
FIG. 10 is a bottom view showing a rotary tool provided in a honing apparatus according to another embodiment of the present invention.

Although the base member 41 of each guide member 40 is constituted of a single component in the above description, each guide member 40 may alternatively include a base member 41 constituted of multiple components. FIG. 10 is a bottom view showing a rotary tool 60 provided in a honing apparatus according to another embodiment of the present invention. In FIG. 10, components similar to those shown in FIG. 3 are given the same reference numerals, and descriptions thereof will be omitted. As shown in FIG. 10, the guide members 40 each include a base member 41 fixed to the outer periphery of the tool body 21, and a slide member 42 fixed to the base member 41. The base member 41 is constituted of a first base portion 41*a* located adjacent to the tool body 21 and a second base portion 41*b* located adjacent to the slide member 42. Furthermore, the second base portion 41*b* of the base member 41 is composed of a ceramic material having insulating properties. Specifically, the second base portion 41*b* of the base member 41 is composed of a material having higher insulating properties than the aforementioned slide member 42. Accordingly, even when the base member 41 is constituted of multiple components in this manner, the second base portion 41*b* provided as an insulation layer in the base member 41 can block the electric current used for the electrolytic dressing. Consequently, similar to the aforementioned rotary tool 13, electrolytic dressing can be performed on the honing grindstones 11 and 12, and abrasion of the guide members 40 can be minimized.

Although the second base portion 41*b* located adjacent to the slide member 42 functions as the insulation layer in the case shown in FIG. 10, the first base portion 41*a* located adjacent to the tool body 21 may alternatively function as the insulation layer. Moreover, each base member 41 may be constituted of three or more components, and in that case, each base member 41 is provided with one or more insulation layers. Accordingly, each base member 41 may have any kind of structure so long as the tool body 21 and the slide member 42 are electrically insulated from each other.

The present invention is not to be limited to the above embodiments, and various modifications are permissible within the scope of the invention. For example, although the cylinder block 18 is used as a workpiece in the above description, the honing apparatus 10 according to the present invention may be applied to other kinds of workpieces. Furthermore, although the cylindrical electrode sleeve 52 is fitted to the tool guide 20 in the above description, the electrode member is not limited to an endless electrode sleeve 52. For example, an arc-shaped electrode member may be fitted to the tool guide 20. Moreover, although the electrolytic dressing is performed before and after the honing process in the timing chart in FIG. 7, the electrolytic dressing may alternatively be performed at every preset processing time point or for every preset number of processing times.

What is claimed is:

1. A honing apparatus including a rotary tool that grinds an inner cylindrical surface to be formed in a workpiece, and a tool guide disposed at one end of the workpiece and having a guide hole that guides the rotary tool to the inner cylindrical surface, the honing apparatus comprising:

a guide member provided on an outer periphery of the rotary tool and having a slide surface that slides in the guide hole;

an electrically conductive grindstone provided on the outer periphery of the rotary tool and having a grinding surface that grinds the inner cylindrical surface;

an electrode member provided in the guide hole of the tool guide and facing the grinding surface of the electrically conductive grindstone when the rotary tool passes through the guide hole; and an electrolytic dressing unit for applying voltage to the electrically conductive grindstone and the electrode member when the rotary tool passes through the guide hole, wherein the guide member includes a base member provided on the outer periphery of the rotary tool, and a slide member provided on the base member and serving as the slide surface, and wherein the base member is composed of a material having higher insulating properties than the slide member, and the slide member is composed of a material having higher abrasion resistance properties than the base member.

2. The honing apparatus according to claim 1, wherein the base member is composed of a ceramic material.

3. The honing apparatus according to claim 1, wherein the slide member is composed of a cemented carbide material.

4. The honing apparatus according to claim 2, wherein the slide member is composed of a cemented carbide material.

5. The honing apparatus according to claim 1, wherein the slide surface of the guide member has an air channel that guides air used for processing-diameter measurement.

6. The honing apparatus according to claim 2, wherein the slide surface of the guide member has an air channel that guides air used for processing-diameter measurement.

7. The honing apparatus according to claim 3, wherein the slide surface of the guide member has an air channel that guides air used for processing-diameter measurement.

8. The honing apparatus according to claim 4, wherein the slide surface of the guide member has an air channel that guides air used for processing-diameter measurement.

9. A honing apparatus including a rotary tool that grinds an inner cylindrical surface to be formed in a workpiece, and a tool guide disposed at one end of the workpiece and having a guide hole that guides the rotary tool to the inner cylindrical surface, the honing apparatus comprising:

a guide member provided on an outer periphery of the rotary tool and having a slide surface that slides in the guide hole;

an electrically conductive grindstone provided on the outer periphery of the rotary tool and having a grinding surface that grinds the inner cylindrical surface;

an electrode member provided in the guide hole of the tool guide and facing the grinding surface of the electrically conductive grindstone when the rotary tool passes through the guide hole; and an electrolytic dressing unit for applying voltage to the electrically conductive grindstone and the electrode member when the rotary tool passes through the guide hole, wherein the guide member includes a base member provided on the outer periphery of the rotary tool and having an insulation layer, and a slide member provided on the base member and serving as the slide surface, and wherein the insulation layer is composed of a material having higher insulating properties than the slide member, and the slide member is composed of a material having higher abrasion resistance properties than the insulation layer.

10. The honing apparatus according to claim 9, wherein the insulation layer is composed of a ceramic material.

11. The honing apparatus according to claim 9, wherein the slide member is composed of a cemented carbide material.

12. The honing apparatus according to claim 10, wherein the slide member is composed of a cemented carbide material.

13. The honing apparatus according to claim 9, wherein the slide surface of the guide member has an air channel that guides air used for processing-diameter measurement.

14. The honing apparatus according to claim 10, wherein the slide surface of the guide member has an air channel that guides air used for processing-diameter measurement.

15. The honing apparatus according to claim 11, wherein the slide surface of the guide member has an air channel that guides air used for processing-diameter measurement.

16. The honing apparatus according to claim 12, wherein the slide surface of the guide member has an air channel that guides air used for processing-diameter measurement.

* * * * *